US010650753B2

(12) United States Patent
Yang et al.

(10) Patent No.: US 10,650,753 B2
(45) Date of Patent: May 12, 2020

(54) PIXEL CIRCUIT, METHOD FOR DRIVING THE SAME, DISPLAY PANEL AND DISPLAY DEVICE

(71) Applicant: BOE Technology Group Co., Ltd., Beijing (CN)

(72) Inventors: Chengchung Yang, Beijing (CN); Kuanjun Peng, Beijing (CN); Xueling Gao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/216,122

(22) Filed: Dec. 11, 2018

(65) Prior Publication Data

US 2019/0325826 A1 Oct. 24, 2019

(30) Foreign Application Priority Data

Apr. 24, 2018 (CN) ..... 2018 1 0375273

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/3233* (2013.01); *G09G 3/3266* (2013.01);
(Continued)

(58) Field of Classification Search
CPC .. G09G 3/3258; G09G 3/3291; G09G 3/3266; G09G 3/3233; G09G 2300/0439;
(Continued)

(56) References Cited

U.S. PATENT DOCUMENTS

2008/0211796 A1 9/2008 Yangwan et al.
2009/0108763 A1* 4/2009 Han ..... G09G 3/3233 315/169.3

(Continued)

FOREIGN PATENT DOCUMENTS

CN 104200777 A 12/2014
CN 107358918 A 11/2017

(Continued)

OTHER PUBLICATIONS

Office Action for 201810375273.2 received OA dated Jul. 30, 2019.

*Primary Examiner* — Premal R Patel
(74) *Attorney, Agent, or Firm* — Arent Fox LLP; Michael Fainberg

(57) ABSTRACT

A pixel circuit, a method for driving the same, a display panel, and a display device are provided. The pixel circuit includes: a drive controlling sub-circuit, a data writing sub-circuit, a light-emission controlling sub-circuit, a first resetting sub-circuit, a second resetting sub-circuit, a charging sub-circuit, a capacitor sub-circuit, and a light-emitting element; and the respective sub-circuits cooperate in operation so that charges in the drive controlling sub-circuit in the pixel circuit can be reset, and driving current of the drive controlling sub-circuit to drive the light-emitting element to emit light can be made dependent upon the voltage of a data signal, and independent of threshold voltage of the drive controlling sub-circuit.

13 Claims, 4 Drawing Sheets

(51) Int. Cl.
*G09G 3/3266* (2016.01)
*G09G 3/3291* (2016.01)

(52) U.S. Cl.
CPC ... *G09G 3/3291* (2013.01); *G09G 2300/0426* (2013.01); *G09G 2300/0439* (2013.01)

(58) Field of Classification Search
CPC ... G09G 2300/0426; G09G 2320/0233; G09G 3/3225
See application file for complete search history.

(56) References Cited

U.S. PATENT DOCUMENTS

| | | | | |
|---|---|---|---|---|
| 2016/0275866 | A1* | 9/2016 | Liu | G09G 3/3233 |
| 2018/0047337 | A1* | 2/2018 | Zhu | G09G 3/3233 |

FOREIGN PATENT DOCUMENTS

| | | | |
|---|---|---|---|
| CN | 107452332 | A | 12/2017 |
| CN | 107452334 | A | 12/2017 |

* cited by examiner

PIXEL CIRCUIT, METHOD FOR DRIVING THE SAME, DISPLAY PANEL AND DISPLAY DEVICE

CROSS-REFERENCES TO RELATED APPLICATIONS

This application claims priority to Chinese patent application No. 201810375273.2 filed on Apr. 24, 2018, which is incorporated herein by reference in its entirety.

FIELD

The present disclosure relates to the field of organic light-emitting technologies, and particularly to a pixel circuit, a method for driving the same, a display panel, and a display device.

BACKGROUND

An Organic Light-Emitting Diode (OLED) display is one of focuses in the research field of displays at present, and OLED display has lower power consumption, a lower production cost, self-light-emission, a wider angle of view, a higher response speed, and other advantages as compared with a Liquid Crystal Display (LCD). At present, the OLED display has come to take the place of the traditional LCD display in the display fields of a mobile phone, a Personal Digital Assistant (PDA), a digital camera, etc., where the design of a pixel circuit is a core technology in the OLED display, and a research thereon is of great significance.

SUMMARY

In one aspect, an embodiment of the disclosure provides a pixel circuit. The pixel circuit includes: a drive controlling sub-circuit, a data writing sub-circuit, a light-emission controlling sub-circuit, a first resetting sub-circuit, a second resetting sub-circuit, a charging sub-circuit, a capacitor sub-circuit, and a light-emitting element. The drive controlling sub-circuit has a control terminal connected with a first node, a first terminal connected with a second node, and a second terminal connected with a third node; and the drive controlling sub-circuit is configured to provide the third node with a potential of the second node under a control of a potential of the first node; the data writing sub-circuit has a control terminal connected with a scan signal terminal, a first terminal connected with a data signal terminal, and a second terminal connected with the second node; and the data writing sub-circuit is configured to provide the second node with a signal of the data signal terminal under a control of the scan signal terminal; the light-emission controlling sub-circuit has a control terminal connected with a light-emission control signal terminal, a first terminal connected with the third node, and a second terminal connected with a fourth node; and the light-emission controlling sub-circuit is configured to connect the third node with the fourth node under a control of the light-emission control signal terminal; the first resetting sub-circuit has a control terminal connected with a first signal control terminal, a first terminal connected with a reset signal terminal, and a second terminal connected with the fourth node; and the first resetting sub-circuit is configured to provide the fourth node with a signal of the reset signal terminal under the control of the first signal control terminal; the second resetting sub-circuit has a control terminal connected with the first signal control terminal, a first terminal connected with the third node, and a second terminal connected with the first node; and the second resetting sub-circuit is configured to provide the first node with a signal of the third node under the control of the first signal control terminal; the charging sub-circuit has a control terminal connected with the first signal control terminal, a first terminal connected with the first voltage signal terminal, and a second terminal connected with the second node; and the charging sub-circuit is configured to provide the second node with a signal of the first voltage signal terminal under the control of the first signal control terminal; the capacitor sub-circuit has a first terminal connected with the first node, and a second terminal connected with the first voltage signal terminal, and the capacitor sub-circuit is configured to maintain a stable voltage difference between the first node and the first voltage signal terminal; and the light-emitting element has an anode connected with the fourth node, and a cathode connected with a second voltage signal terminal.

In a possible implementation, in the pixel circuit above according to the embodiment of the disclosure, the drive controlling sub-circuit includes: a driving transistor, and the driving transistor has a gate connected with the first node, a first electrode connected with the second node, and a second electrode connected with the third node.

In a possible implementation, in the pixel circuit above according to the embodiment of the disclosure, the data writing sub-circuit includes: a third transistor, and the third transistor has a gate connected with the scan signal terminal, a first electrode connected with the data signal terminal, and a second electrode connected with the second node.

In a possible implementation, in the pixel circuit above according to the embodiment of the disclosure, the light-emission controlling sub-circuit includes: a fifth transistor, and the fifth transistor has a gate connected with the light-emission control signal terminal, a first electrode connected with the third node, and a second electrode connected with the fourth node.

In a possible implementation, in the pixel circuit above according to the embodiment of the disclosure, the first resetting sub-circuit includes: a fourth transistor, and the fourth transistor has a gate connected with the first signal control terminal, a first electrode connected with the reset signal terminal, and a second electrode connected with the fourth node.

In a possible implementation, in the pixel circuit above according to the embodiment of the disclosure, the second resetting sub-circuit includes: a first transistor, and the first transistor has a gate connected with the first signal control terminal, a first electrode connected with the third node, and a second electrode connected with the first node.

In a possible implementation, in the pixel circuit above according to the embodiment of the disclosure, the charging sub-circuit includes: a second transistor, and the second transistor has a gate connected with the first signal control terminal, a first electrode connected with the first voltage signal terminal, and a second electrode connected with the second node.

In a possible implementation, in the pixel circuit above according to the embodiment of the disclosure, the capacitor sub-circuit includes: a first capacitor, and the first capacitor has a first terminal connected with the first node, and a second terminal connected with the first voltage signal terminal.

In a possible implementation, in the pixel circuit above according to the embodiment of the disclosure, the charging sub-circuit includes: a second transistor, wherein the second transistor has a gate connected with the first signal control terminal, a first electrode connected with the first voltage signal terminal, and a second electrode connected with the second node; the first resetting sub-circuit includes: a fourth transistor, wherein the fourth transistor has a gate connected with the first signal control terminal, a first electrode connected with the reset signal terminal, and a second electrode connected with the fourth node; and the second resetting sub-circuit includes: a first transistor, wherein the first transistor has a gate connected with the first signal control terminal, a first electrode connected with the third node, and a second electrode connected with the first node; wherein the second transistor is an N-type transistor, and the first transistor and the fourth transistors are P-type transistors; or the second transistor is a P-type transistor, and the first transistor and the fourth transistors are N-type transistors.

In a possible implementation, in the pixel circuit above according to the embodiment of the disclosure, all the other transistors than the second transistor are P-type transistors.

In another aspect, an embodiment of the disclosure further provides a method for driving the pixel circuit according to any one of the embodiments above of the disclosure. The method includes: in a reset period, providing, by the first resetting sub-circuit, the fourth node with the signal of the reset signal terminal under the control of the first signal control terminal, providing, by the light-emission controlling sub-circuit, the third node with the potential of the fourth node under the control of the light-emission control signal terminal, and providing, by the second resetting sub-circuit, the first node with the potential of the third node under the control of the first signal control terminal; in a charging period, providing, by the charging sub-circuit, the second node with the signal of the first voltage signal terminal under the control of the first signal control terminal; in a data writing period, providing, by the data writing sub-circuit, the second node with the signal of the data signal terminal under the control of the scan signal terminal, compensating, by the drive controlling sub-circuit, threshold voltage of the driving transistor under the joint action of the potential of the first node, and the potential of the second node, and connecting, by the second resetting sub-circuit, the third node with the first node under the control of the first signal control terminal; and in a light-emission period, providing, by the charging sub-circuit, the second node with the signal of the first voltage signal terminal under the control of the first signal control terminal, providing, by the drive controlling sub-circuit, the light-emitting element with driving voltage under the control of the potential of the first node, and providing, by the light-emission controlling sub-circuit, the fourth node with the level of the third node under the control of the light-emission control signal terminal to drive the light-emitting element to emit light.

In another aspect, an embodiment of the disclosure further provides an organic light-emitting display panel including a plurality of pixel circuits according to any one of the embodiments above of the disclosure, which are arranged in a matrix.

In another aspect, an embodiment of the disclosure further provides a display device including the organic light-emitting display panel according to any one of the embodiments above of the disclosure.

DETAILED DESCRIPTION

Unlike the LCD in which the luminance is controlled using stable voltage, the OLED is current-driven, and shall be controlled using stable current to emit light. Threshold voltage $V_{th}$ of driving transistors in pixel circuits may become non-uniform due to a process factor, an aging element, etc., so that current flowing through different OLED pixels may differ, thus making display luminance non-uniform.

Furthermore a temporary afterimage may occur at the pixels due to a hysteretic effect of the driving transistors, thus further making the display luminance non-uniform, and consequently degrading a display effect of the entire image.

Implementations of the pixel circuit, the method for driving the same, the display panel, and the display device according to the embodiments of the disclosure will be described below in details with reference to the drawings.

Figure 1:
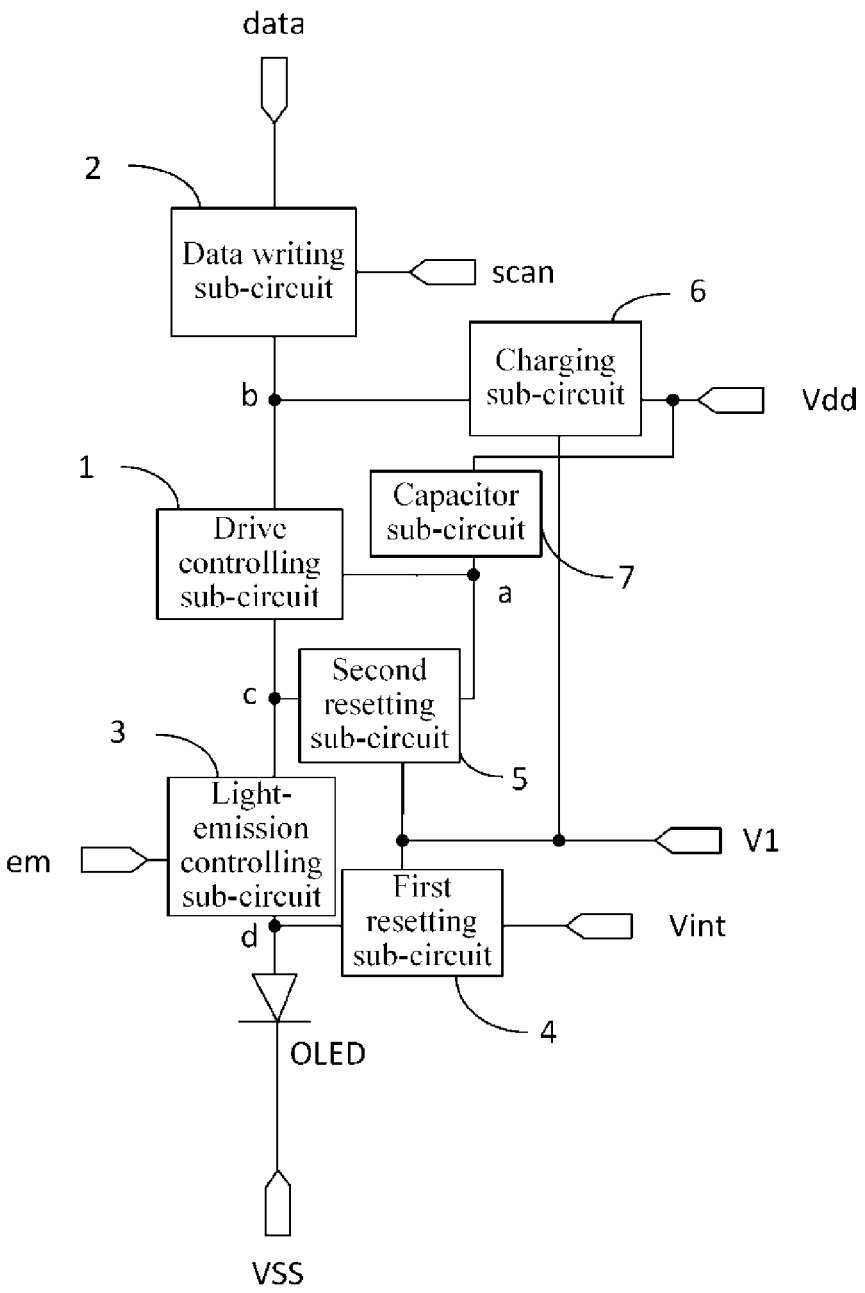
FIG. 1 is a schematic structural diagram of a pixel circuit according to an embodiment of the disclosure.

As illustrated in FIG. 1, a pixel circuit according to an embodiment of the disclosure includes: a drive controlling sub-circuit 1, a data writing sub-circuit 2, a light-emission controlling sub-circuit 3, a first resetting sub-circuit 4, a second resetting sub-circuit 5, a charging sub-circuit 6, a capacitor sub-circuit 7, and a light-emitting element OLED.

The drive controlling sub-circuit 1 has a control terminal connected with a first node a, a first terminal connected with a second node b, and a second terminal connected with a third node c. The drive controlling sub-circuit 1 is configured to provide the third node c with the potential of the second node b under the control of the potential of the first node a.

The data writing sub-circuit 2 has a control terminal connected with a scan signal terminal scan, a first terminal connected with a data signal terminal data, and a second terminal connected with the second node b; and the data writing sub-circuit 2 is configured to provide the second node b with a signal of the data signal terminal data under the control of the scan signal terminal scan.

The light-emission controlling sub-circuit 3 has a control terminal connected with a light-emission control signal terminal em, a first terminal connected with the third node c, and a second terminal connected with a fourth node d; and the light-emission controlling sub-circuit 3 is configured to connect the third node c with the fourth node d under the control of the light-emission control signal terminal em.

The first resetting sub-circuit 4 has a control terminal connected with a first signal control terminal V1, a first terminal connected with a reset signal terminal Vint, and a second terminal connected with the fourth node d; and the first resetting sub-circuit 4 is configured to provide the fourth node d with a signal of the reset signal terminal Vint under the control of the first signal control terminal V1.

The second resetting sub-circuit 5 has a control terminal connected with the first signal control terminal V1, a first terminal connected with the third node c, and a second terminal connected with the first node a; and the second resetting sub-circuit 5 is configured to provide the first node a with a signal of the third node c under the control of the first signal control terminal V1.

The charging sub-circuit 6 has a control terminal connected with the first signal control terminal V1, a first terminal connected with the first voltage signal terminal Vdd, and a second terminal connected with the second node b; and the charging sub-circuit 6 is configured to provide the second node b with a signal of the first voltage signal terminal Vdd under the control of the first signal control terminal V1.

The capacitor sub-circuit 7 has a first terminal connected with the first node a, and a second terminal connected with the first voltage signal terminal Vdd, and the capacitor sub-circuit 7 is configured to maintain a stable voltage difference between the first node a and the first voltage signal terminal Vdd.

The light-emitting element OLED has an anode connected with the fourth node d, and a cathode connected with a second voltage signal terminal VSS.

The pixel circuit above according to the embodiment of the disclosure includes: the drive controlling sub-circuit, the data writing sub-circuit, the light-emission controlling sub-circuit, the first resetting sub-circuit, the second resetting sub-circuit, the charging sub-circuit, the capacitor sub-circuit, and the light-emitting element. The respective sub-circuits cooperate in operation so that charges in the drive controlling sub-circuit in the pixel circuit can be reset to thereby alleviate a temporary afterimage, and driving current of the drive controlling sub-circuit to drive the light-emitting element to emit light can be made dependent upon the voltage of the data signal, and independent of threshold voltage of the drive controlling sub-circuit to thereby avoid the light-emitting element from being affected by the threshold voltage of the drive controlling sub-circuit, that is, when the same data signal is applied to different pixel elements, an image can be displayed with uniform luminance, thus improving the luminance uniformity of the image in a display area of a display device.

The disclosure will be described below in details in connection with specific embodiments thereof. It shall be noted that these embodiments are intended to better set forth the disclosure, but not to limit the disclosure thereto.

Figure 2:
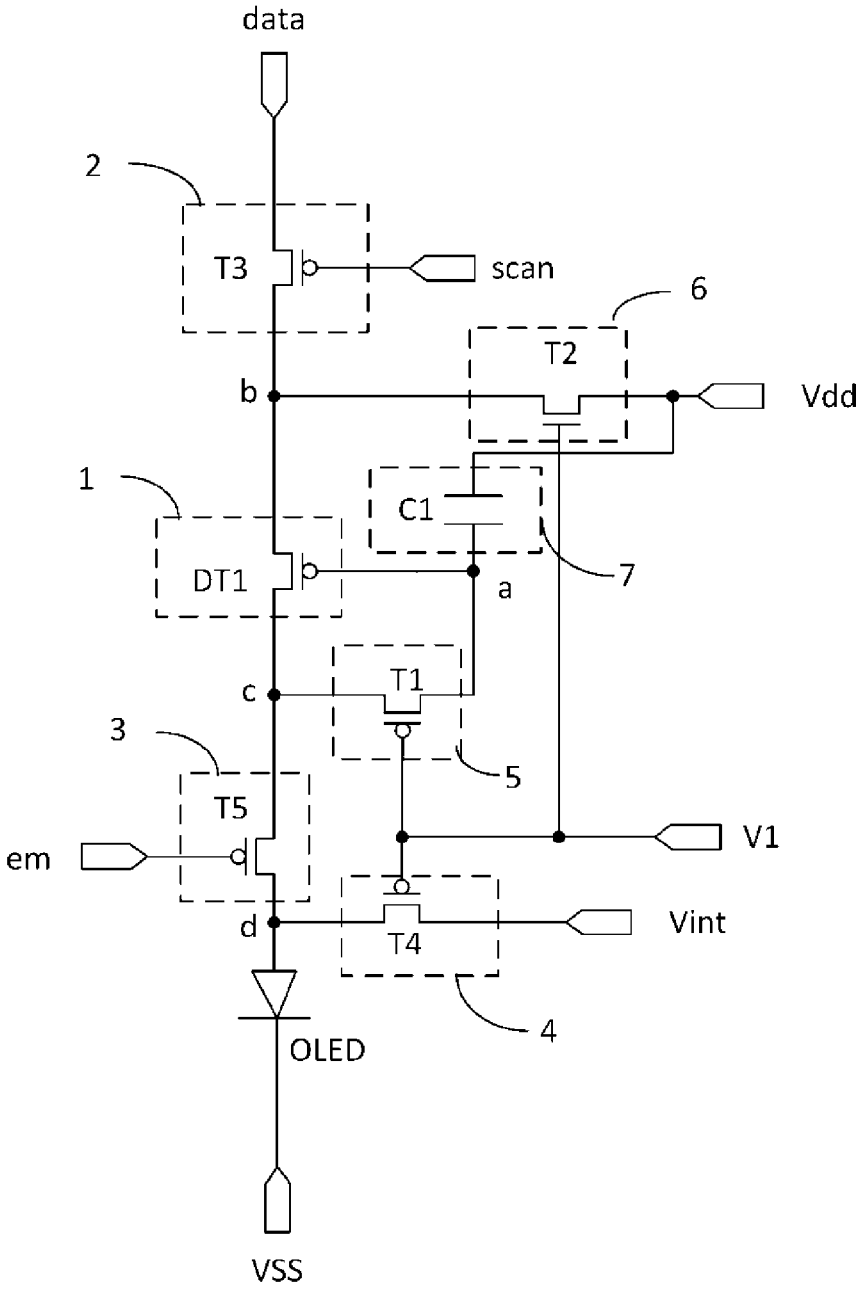
FIG. 2 is a schematic structural diagram in details of the pixel circuit according to the embodiment of the disclosure.

In some embodiments of the disclosure, in the pixel circuit above, as illustrated in FIG. 2, the drive controlling sub-circuit 1 includes: a driving transistor DT1.

The driving transistor DT1 has a gate connected with the first node a, a first electrode connected with the second node b, and a second electrode connected with the third node c.

In a specific implementation, in the pixel circuit above according to the embodiment of the disclosure, the driving transistor DT1 is a P-type transistor.

In some embodiments of the disclosure, in the pixel circuit above, as illustrated in FIG. 2, the data writing sub-circuit 2 includes: a third transistor T3.

The third transistor T3 has a gate connected with the scan signal terminal scan, a first electrode connected with the data signal terminal data, and a second electrode connected with the second node b.

In a specific implementation, as illustrated in FIG. 2, the third transistor T3 can be an N-type transistor (not illustrated), and in this manner, when a signal of the scan signal terminal scan is at a high level, the third transistor T3 is turned on, and when the signal of the scan signal terminal scan is at a low level, the third transistor T3 is turned off; or the third transistor T3 can be a P-type transistor, and in this manner, when a signal of the scan signal terminal scan is at a low level, the third transistor T3 is turned on, and when the signal of the scan signal terminal scan is at a high level, the third transistor T3 is turned off, although the embodiment of the disclosure will not be limited thereto.

Specifically in the pixel circuit above according to the embodiment of the disclosure, when the third transistor is turned on under the control of the scan signal terminal, the data signal transmitted by the data signal terminal is transmitted to the second node through the third transistor which is turned on, to thereby reset the voltage of the second node.

The structure of the data writing sub-circuit in the pixel circuit has been described above only by way of an example, and in a specific implementation, the structure of the data writing sub-circuit will not be limited to the structure above according to the embodiment of the disclosure, but can alternatively be another structure which can occur to those skilled in the art, although the embodiment of the disclosure will not be limited thereto.

In some embodiments of the disclosure, in the pixel circuit above, as illustrated in FIG. 2, the light-emission controlling sub-circuit 3 includes: a fifth transistor T5.

The fifth transistor T5 has a gate connected with the light-emission control signal terminal em, a first electrode connected with the third node c, and a second electrode connected with the fourth node d.

In a specific implementation, as illustrated in FIG. 2, the fifth transistor T5 can be an N-type transistor (not illustrated), and in this manner, when the signal transmitted by the light-emission control signal terminal em is at a high level, the fifth transistor T5 is turned on, and when the signal transmitted by the light-emission control signal terminal em is at a low level, the fifth transistor T5 is turned off; or the fifth transistor T5 can be a P-type transistor, and in this manner, when the signal transmitted by the light-emission control signal terminal em is at a low level, the fifth transistor T5 is turned on, and when the signal transmitted by the light-emission control signal terminal em is at a high level, the fifth transistor T5 is turned off, although the embodiment of the disclosure will not be limited thereto.

Specifically in the pixel circuit above according to the embodiment of the disclosure, when the fifth transistor is turned on under the control of the light-emission control signal terminal, the third node is connected with the fourth node.

The structure of the light-emission controlling sub-circuit in the pixel circuit has been described above only by way of an example, and in a specific implementation, the structure of the light-emission controlling sub-circuit will not be limited to the structure above according to the embodiment of the disclosure, but can alternatively be another structure which can occur to those skilled in the art, although the embodiment of the disclosure will not be limited thereto.

In some embodiments of the disclosure, in the pixel circuit above, as illustrated in FIG. 2, the first resetting sub-circuit 4 includes: a fourth transistor T4.

The fourth transistor T4 has a gate connected with the first signal control terminal V1, a first electrode connected with the reset signal terminal Vint, and a second electrode connected with the fourth node d.

In a specific implementation, as illustrated in FIG. 2, the fourth transistor T4 can be an N-type transistor (not illustrated), and in this manner, when the signal transmitted by the first signal control terminal V1 is at a high level, the fourth transistor T4 is turned on, and when the signal transmitted by the first signal control terminal V1 is at a low level, the fourth transistor T4 is turned off; or the fourth transistor T4 can be a P-type transistor, and in this manner, when the signal transmitted by the first signal control terminal V1 is at a low level, the fourth transistor T4 is turned on, and when the signal transmitted by the first signal control terminal V1 is at a high level, the fourth transistor T4 is turned off, although the embodiment of the disclosure will not be limited thereto.

Specifically in the pixel circuit above according to the embodiment of the disclosure, when the fourth transistor is turned on under the control of the first signal terminal, the fourth node is provided with the signal of the reset signal terminal.

The structure of the first resetting sub-circuit in the pixel circuit has been described above only by way of an example, and in a specific implementation, the structure of the first resetting sub-circuit will not be limited to the structure above according to the embodiment of the disclosure, but can alternatively be another structure which can occur to those skilled in the art, although the embodiment of the disclosure will not be limited thereto.

In some embodiments of the disclosure, in the pixel circuit above, as illustrated in FIG. 2, the second resetting sub-circuit 5 includes: a first transistor T1.

The first transistor T1 has a gate connected with the first signal control terminal V1, a first electrode connected with the third node c, and a second electrode connected with the first node a.

In a specific implementation, as illustrated in FIG. 2, the first transistor T1 can be an N-type transistor (not illustrated), and in this manner, when the signal transmitted by the first signal control terminal V1 is at a high level, the first transistor T1 is turned on, and when the signal transmitted by the first signal control terminal V1 is at a low level, the first transistor T1 is turned off; or the first transistor T1 can be a P-type transistor, and in this manner, when the signal transmitted by the first signal control terminal V1 is at a low level, the first transistor T1 is turned on, and when the signal transmitted by the first signal control terminal V1 is at a high level, the first transistor T1 is turned off, although the embodiment of the disclosure will not be limited thereto.

Specifically in the pixel circuit above according to the embodiment of the disclosure, when the first transistor is turned on under the control of the first signal control terminal, the first node is provided with the signal of the third node.

The structure of the second resetting sub-circuit in the pixel circuit has been described above only by way of an example, and in a specific implementation, the structure of the second resetting sub-circuit will not be limited to the structure above according to the embodiment of the disclosure, but can alternatively be another structure which can occur to those skilled in the art, although the embodiment of the disclosure will not be limited thereto.

In some embodiments of the disclosure, in the pixel circuit above, as illustrated in FIG. 2, the charging sub-circuit 6 includes: a second transistor T2.

The second transistor T2 has a gate connected with the first signal control terminal V1, a first electrode connected with the first voltage signal terminal Vdd, and a second electrode connected with the second node b.

In a specific implementation, as illustrated in FIG. 2, the second transistor T2 can be an N-type transistor (not illustrated), and in this manner, when the signal transmitted by the first voltage signal terminal Vdd is at a high level, the second transistor T2 is turned on, and when the signal transmitted by the first voltage signal terminal Vdd is at a low level, the second transistor T2 is turned off; or the second transistor T2 can be a P-type transistor, and in this manner, when the signal transmitted by the first voltage signal terminal Vdd is at a low level, the second transistor T2 is turned on, and when the signal transmitted by the first voltage signal terminal Vdd is at a high level, the second transistor T2 is turned off, although the embodiment of the disclosure will not be limited thereto.

Specifically in the pixel circuit above according to the embodiment of the disclosure, when the second transistor is turned on under the control of the first voltage signal terminal, the second node is provided with a signal of the first voltage signal terminal.

The structure of the charging sub-circuit in the pixel circuit has been described above only by way of an example, and in a specific implementation, the structure of the charging sub-circuit will not be limited to the structure above according to the embodiment of the disclosure, but can alternatively be another structure which can occur to those skilled in the art, although the embodiment of the disclosure will not be limited thereto.

In some embodiments of the disclosure, in the pixel circuit above, as illustrated in FIG. 1, the capacitor sub-circuit 7 includes: a first capacitor C1.

The first capacitor C1 has a first terminal connected with the first node a, and a second terminal connected with the first voltage signal terminal Vdd.

In some embodiments of the disclosure, in the pixel circuit above, the second transistor T2 is an N-type transistor, and the first transistor T1 and the fourth transistor T4 are P-type transistors.

Alternatively, the second transistor T2 is a P-type transistor, and the first transistor T1 and the fourth transistor T4 are N-type transistors.

In a specific implementation, the second transistor is set to a different type from the first transistor and the fourth transistor so that the second transistor, the first transistor, and the fourth transistor can be controlled by the same signal terminal, to thereby reduce the number of control signal terminals and simplify the structure of the circuit.

In some embodiments of the disclosure, in the pixel circuit above, all the other transistors than the second transistor are P-type transistors.

In some embodiments of the disclosure, all the transistors than the second transistor as mentioned in the pixel circuit above can be designed as P-type transistors, or all the transistors than the second transistor can be designed as N-type transistors, so that a process flow of fabricating the pixel circuit can be simplified.

It shall be noted that the embodiment above of the disclosure has been described taking the driving transistor which is a P-type transistor as an example, but the same design principle can also apply to when the driving transistor DT1 is an N-type transistor without departing from the scope of the disclosure.

In a specific implementation, the driving transistor and the transistors can be Thin Film Transistors (TFTs) or Metal Oxide Semiconductor Field-Effect Transistors (MOSFETs), although the embodiment of the disclosure will not be limited thereto. In a specific implementation, the first electrodes and the second electrodes of these transistors can be interchanged with each other in function dependent upon their different transistor types and input signals instead of being distinguished from each other.

An operating process of the pixel circuit according to the embodiment of the disclosure will be described below taking the pixel circuit as illustrated in FIG. 2 as an example. In the following description, 1 represents a high-level signal, and 0 represents a low-level signal.

Figure 3:
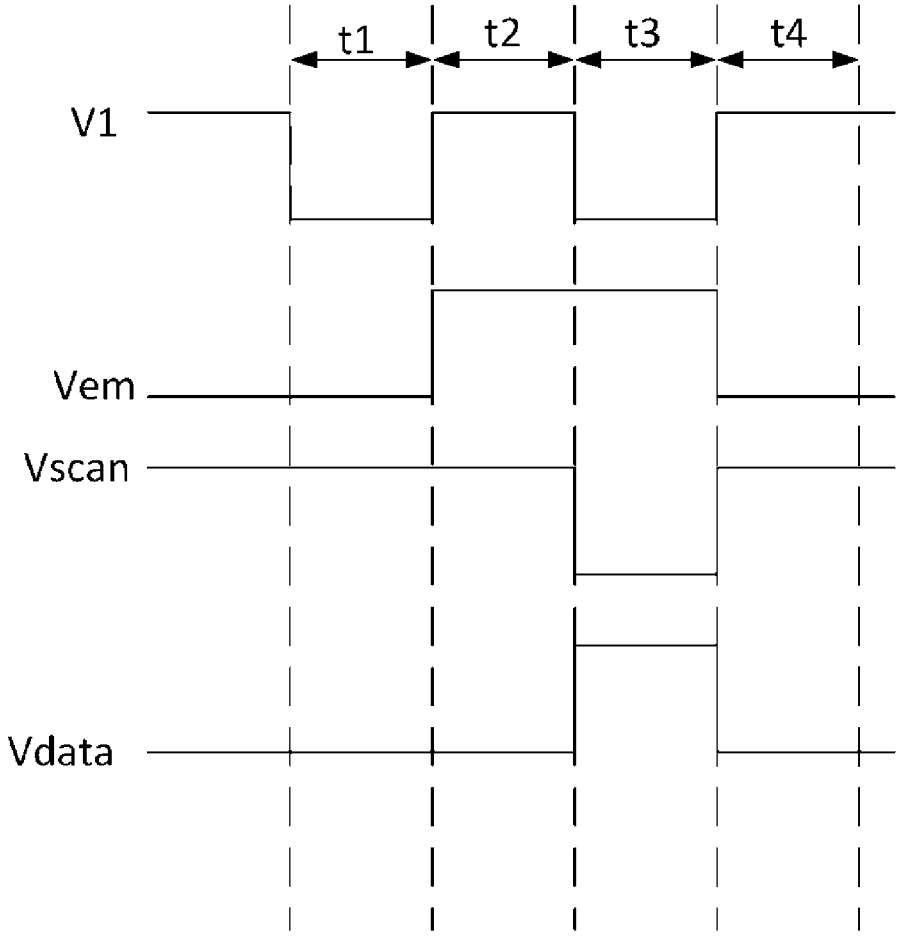
FIG. 3 is a schematic circuit timing diagram of the pixel circuit as illustrated.

In the pixel circuit as illustrated in FIG. 2, the driving transistor DT1, and all the other transistors than the second transistor T2 are P-type transistors, and the respective P-type transistors are turned on at a low level, and turned off at a high level; the second transistor T2 is an N-type transistor, and the N-type transistor is turned on at a high level, and turned off at a low level. FIG. 3 illustrates a corresponding input timing diagram. Specifically there are four selected periods: reset period t1, charging period t2, data writing period t3, and light-emission period t4 in the input timing diagram as illustrated in FIG. 3.

In the period t1, V1=0, Vem=0, Vscan=1, and Vdata=0.

Since the signal of the first signal control terminal V1 is at a low level, the first transistor T1 and the fourth transistor T4 are turned on. Since the signal of the light-emission control signal terminal em is also at a low level, the fifth transistor T5 is also turned on, so that the signal of the reset signal terminal Vint is provided to the first node a through the fourth transistor T4, the fifth transistor T5, and the first transistor T1 which are turned on, to turn on the driving transistor DT1. In this manner, since both the third transistor T3 and the second transistor T2 are turned off, the second node b is floating, so that the voltage of the second node b is discharged through the driving transistor DT1, the fifth transistor T5, and the fourth transistor T4 which are turned on, until the voltage at the second node b is Vint−Vth, and then the driver transistor DT1 is turned off.

In the period t2, V1=1, Vem=1, Vscan=1, and Vdata=0.

Since the signal of the first signal control terminal V1 is at a high level, the second transistor T2 is turned on, and the second node b is provided with the signal of the first voltage signal terminal Vdd, and in this manner, the driving transistor DT1 is turned on (Vgs=Vint−Vdd), so the driving transistor DT1, which is turned on, writes data and is threshold-compensated for; and also since the driving transistor DT1 is turned from the Off state to the On state, charges in the driver transistor DT1 can be reset to thereby avoid an I-V characteristic (a current-voltage characteristic) of the driving transistor from being affected by a state thereof in a last frame, so as to alleviate a temporary afterimage arising from a hysteretic effect thereof.

In the period t3, V1=0, Vem=1, Vscan=0, and Vdata=1.

Since the voltage of the scan signal terminal scan is at a low level, the third transistor T3 is turned on, and the second node b is provided with the signal of the data signal terminal data, that is, the data signal Vdata is written therein; and also since the first signal control terminal V1 is at a low level, the first transistor T1 is turned on, and the first node a is charged to Vdata+Vth, that is, the threshold voltage Vth of the driving transistor DT1 is captured.

It shall be noted that the data signal provided by the data signal terminal can be any voltage signal between a high-level signal and a low-level signal, and the embodiment above has been described only by way of an example in which the data signal which is a high-level signal is a valid data signal, but the voltage of the data signal will not be limited thereto.

In the period t4, V1=1, Vem=0, Vscan=1, and Vdata=0.

Since the first signal control terminal V1 provides a high-level signal, the second transistor T2 is turned on to provide the second node b with the voltage of the first voltage signal terminal Vdd, and also since the signal of the light-emission control signal terminal em is at a low level, the fifth transistor T5 is turned on, and in this manner, current flowing through the light-emitting element OLED is:

$$I_{oled} = k(V_{gs} - V_{th})^2$$

-continued $$= k(V_{data} + V_{th} - Vdd - V_{th})^2$$

$$= k(V_{data} - Vdd)^2.$$

Where $I_{oled}$ is the current flowing through the light-emitting element OLED, k is a structural coefficient, Vdata is the data signal provided by the data signal terminal data, $V_{th}$ is the threshold voltage of the driving transistor DT1, $V_{gs}$ is the voltage difference between the gate and the source of the driving transistor DT1, and Vdd is the voltage of the first voltage signal terminal.

As can be apparent from the description above, the current flowing through the light-emitting element is dependent upon the data signal, and the signal of the first voltage signal terminal, and independent of the threshold voltage Vth of the driving transistor, to thereby avoid the light-emitting element from being affected by the threshold voltage of the driving transistor, that is, when the same data signal is applied to different pixel elements, an image can be displayed with uniform luminance, thus improving the luminance uniformity of the image in a display area of a display device.

Figure 4:
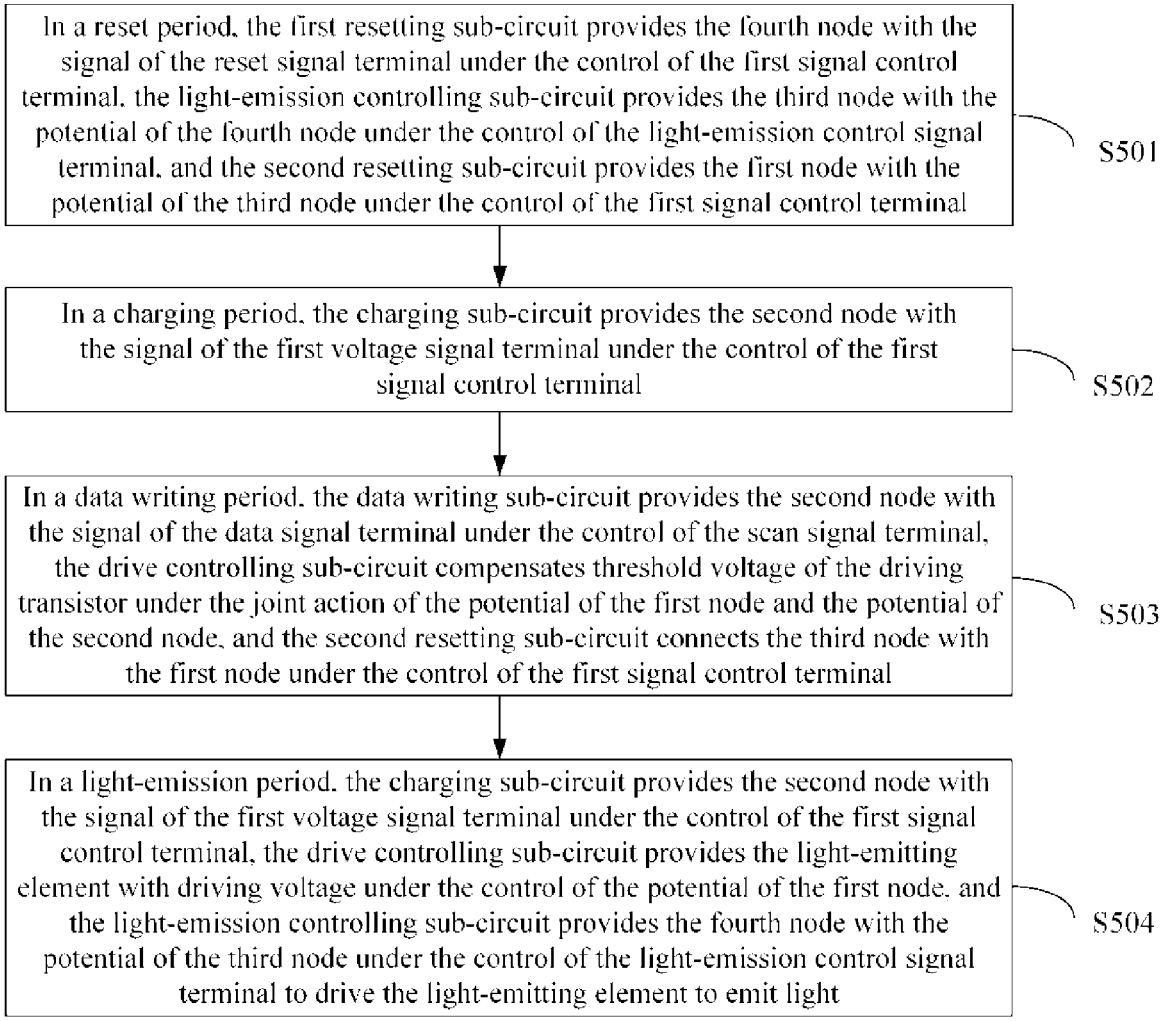
FIG. 4 is a schematic flow chart of a method for driving the pixel circuit according to the embodiment of the disclosure.

Based upon the same idea, an embodiment of the disclosure further provides a method for driving the pixel circuit according to any one of the embodiments above of the disclosure, and as illustrated in FIG. 4, the method includes the following steps.

In the step S501, in a reset period, the first resetting sub-circuit provides the fourth node with the signal of the reset signal terminal under the control of the first signal control terminal, the light-emission controlling sub-circuit provides the third node with the potential of the fourth node under the control of the light-emission control signal terminal, and the second resetting sub-circuit provides the first node with the potential of the third node under the control of the first signal control terminal.

In the step S502, in a charging period, the charging sub-circuit provides the second node with the signal of the first voltage signal terminal under the control of the first signal control terminal.

In the step S503, in a data writing period, the data writing sub-circuit provides the second node with the signal of the data signal terminal under the control of the scan signal terminal, the drive controlling sub-circuit compensates threshold voltage of the driving transistor under the joint action of the potential of the first node, and the potential of the second node, and the second resetting sub-circuit connects the third node with the first node under the control of the first signal control terminal.

In the step S504, in a light-emission period, the charging sub-circuit provides the second node with the signal of the first voltage signal terminal under the control of the first signal control terminal, the drive controlling sub-circuit provides the light-emitting element with driving voltage under the control of the potential of the first node, and the light-emission controlling sub-circuit provides the fourth node with the potential of the third node under the control of the light-emission control signal terminal to drive the light-emitting element to emit light.

FIG. 3 illustrates a timing diagram of the method for driving the pixel circuit, where the period t1 is the reset period, the period t2 is the charging period, the period t3 is the data writing period, and the period t4 is the light-emission period, and reference can be made to the description above of the structure pixel circuit with reference to FIG. 3 for a specific operating principle thereof, so a repeated description thereof will be omitted here.

Based upon the same inventive idea, an embodiment of the disclosure further provides an organic light-emitting display panel including a plurality of pixel circuits according to any one of the embodiments above of the disclosure, which are arranged in a matrix. Since the organic light-emitting display panel addresses the problem under a similar principle to the pixel circuit above, reference can be made to the implementation of the pixel circuit in the embodiment above for an implementation of the pixel circuits in the organic light-emitting display panel, so a repeated description thereof will be omitted here.

Based upon the same inventive idea, an embodiment of the disclosure further provides a display device including the organic light-emitting display panel above according to the embodiment of the disclosure. The display device can be a display, a mobile phone, a TV set, a notebook computer, electronic paper, a digital photo frame, a navigator, an all-in-one machine, etc., and all the other components indispensable to the display device shall readily occur to those ordinarily skilled in the art, so a repeated description thereof will be omitted here, and the embodiment of the disclosure will not be limited thereto.

In the pixel circuit, the method for driving the same, the display panel, and the display device above according to the embodiments of the disclosure, the pixel circuit includes: the drive controlling sub-circuit, the data writing sub-circuit, the light-emission controlling sub-circuit, the first resetting sub-circuit, the second resetting sub-circuit, the charging sub-circuit, the capacitor sub-circuit, and the light-emitting element. The respective sub-circuits cooperate in operation so that charges in the drive controlling sub-circuit in the pixel circuit can be reset to thereby alleviate a temporary after-image, and driving current of the drive controlling sub-circuit to drive the light-emitting element to emit light can be made dependent upon the voltage of the data signal, and independent of threshold voltage of the drive controlling sub-circuit to thereby avoid the light-emitting element from being affected by the threshold voltage of the drive controlling sub-circuit, that is, when the same data signal is applied to different pixel elements, an image can be displayed with uniform luminance, thus improving the luminance uniformity of the image in a display area of the display device.

Evidently those skilled in the art can make various modifications and variations to the disclosure without departing from the spirit and scope of this disclosure. Thus the disclosure is also intended to encompass these modifications and variations thereto so long as the modifications and variations come into the scope of the claims appended to the disclosure and their equivalents.

The invention claimed is:

1. A pixel circuit, comprising: a drive controlling sub-circuit, a data writing sub-circuit, a light-emission controlling sub-circuit, a first resetting sub-circuit, a second resetting sub-circuit, a charging sub-circuit, a capacitor sub-circuit, and a light-emitting element, wherein:

the drive controlling sub-circuit has a control terminal connected with a first node, a first terminal connected with a second node, and a second terminal connected with a third node; and the drive controlling sub-circuit is configured to provide the third node with a potential of the second node under a control of a potential of the first node;

the data writing sub-circuit has a control terminal connected with a scan signal terminal, a first terminal connected with a data signal terminal, and a second terminal connected with the second node; and the data writing sub-circuit is configured to provide the second node with a signal of the data signal terminal under a control of the scan signal terminal;

the light-emission controlling sub-circuit has a control terminal connected with a light-emission control signal terminal, a first terminal connected with the third node, and a second terminal connected with a fourth node; and the light-emission controlling sub-circuit is configured to connect the third node with the fourth node under a control of the light-emission control signal terminal;

the first resetting sub-circuit has a control terminal connected with a first signal control terminal, a first terminal connected with a reset signal terminal, and a second terminal connected with the fourth node; and the first resetting sub-circuit is configured to provide the fourth node with a signal of the reset signal terminal under a control of the first signal control terminal;

the second resetting sub-circuit has a control terminal connected with the first signal control terminal, a first terminal connected with the third node, and a second terminal connected with the first node; and the second resetting sub-circuit is configured to provide the first node with a signal of the third node under the control of the first signal control terminal;

the charging sub-circuit has a control terminal connected with the first signal control terminal, a first terminal connected with the first voltage signal terminal, and a second terminal connected with the second node; and the charging sub-circuit is configured to provide the second node with a signal of the first voltage signal terminal under the control of the first signal control terminal;

the capacitor sub-circuit has a first terminal connected with the first node, and a second terminal connected with the first voltage signal terminal, and the capacitor sub-circuit is configured to maintain a stable voltage difference between the first node and the first voltage signal terminal; and the light-emitting element has an anode connected with the fourth node, and a cathode connected with a second voltage signal terminal.

2. The pixel circuit according to claim 1, wherein the drive controlling sub-circuit comprises: a driving transistor, and the driving transistor has a gate connected with the first node, a first electrode connected with the second node, and a second electrode connected with the third node.

3. The pixel circuit according to claim 1, wherein the data writing sub-circuit comprises: a third transistor, and the third transistor has a gate connected with the scan signal terminal, a first electrode connected with the data signal terminal, and a second electrode connected with the second node.

4. The pixel circuit according to claim 1, wherein the light-emission controlling sub-circuit comprises: a fifth transistor, and the fifth transistor has a gate connected with the light-emission control signal terminal, a first electrode connected with the third node, and a second electrode connected with the fourth node.

5. The pixel circuit according to claim 1, wherein the first resetting sub-circuit comprises: a fourth transistor, and the fourth transistor has a gate connected with the first signal control terminal, a first electrode connected with the reset signal terminal, and a second electrode connected with the fourth node.

6. The pixel circuit according to claim 1, wherein the second resetting sub-circuit comprises: a first transistor, and the first transistor has a gate connected with the first signal control terminal, a first electrode connected with the third node, and a second electrode connected with the first node.

7. The pixel circuit according to claim 1, wherein the charging sub-circuit comprises: a second transistor, and the second transistor has a gate connected with the first signal control terminal, a first electrode connected with the first voltage signal terminal, and a second electrode connected with the second node.

8. The pixel circuit according to claim 1, wherein the capacitor sub-circuit comprises: a first capacitor, and the first capacitor has a first terminal connected with the first node, and a second terminal connected with the first voltage signal terminal.

9. The pixel circuit according to claim 1, wherein the charging sub-circuit comprises: a second transistor, wherein the second transistor has a gate connected with the first signal control terminal, a first electrode connected with the first voltage signal terminal, and a second electrode connected with the second node;

the first resetting sub-circuit comprises: a fourth transistor, wherein the fourth transistor has a gate connected with the first signal control terminal, a first electrode connected with the reset signal terminal, and a second electrode connected with the fourth node; and the second resetting sub-circuit comprises: a first transistor, wherein the first transistor has a gate connected with the first signal control terminal, a first electrode connected with the third node, and a second electrode connected with the first node;

wherein the second transistor is an N-type transistor, and the first transistor and the fourth transistors are P-type transistors; or the second transistor is a P-type transistor, and the first transistor and the fourth transistors are N-type transistors.

10. The pixel circuit according to claim 1, wherein the drive controlling sub-circuit comprises: a driving transistor, and the driving transistor has a gate connected with the first node, a first electrode connected with the second node, and a second electrode connected with the third node;

wherein the data writing sub-circuit comprises: a third transistor, and the third transistor has a gate connected with the scan signal terminal, a first electrode connected with the data signal terminal, and a second electrode connected with the second node;

wherein the light-emission controlling sub-circuit comprises: a fifth transistor, and the fifth transistor has a gate connected with the light-emission control signal terminal, a first electrode connected with the third node, and a second electrode connected with the fourth node;

wherein the first resetting sub-circuit comprises: a fourth transistor, and the fourth transistor has a gate connected with the first signal control terminal, a first electrode connected with the reset signal terminal, and a second electrode connected with the fourth node;

wherein the second resetting sub-circuit comprises: a first transistor, and the first transistor has a gate connected with the first signal control terminal, a first electrode connected with the third node, and a second electrode connected with the first node;

wherein the charging sub-circuit comprises: a second transistor, and the second transistor has a gate connected with the first signal control terminal, a first electrode connected with the first voltage signal terminal, and a second electrode connected with the second node;

wherein the capacitor sub-circuit comprises: a first capacitor, and the first capacitor has a first terminal connected with the first node, and a second terminal connected with the first voltage signal terminal;

wherein the second transistor is a N-type transistor, and the first transistor, the third transistor, the fourth transistor, the fifth transistor, and the driving transistor are P-type transistors.

11. A method for driving the pixel circuit according to claim 1, the method comprising:

in a reset period, providing, by the first resetting sub-circuit, the fourth node with the signal of the reset signal terminal under the control of the first signal control terminal, providing, by the light-emission controlling sub-circuit, the third node with the potential of the fourth node under the control of the light-emission control signal terminal, and providing, by the second resetting sub-circuit, the first node with the potential of the third node under the control of the first signal control terminal;

in a charging period, providing, by the charging sub-circuit, the second node with the signal of the first voltage signal terminal under the control of the first signal control terminal;

in a data writing period, providing, by the data writing sub-circuit, the second node with the signal of the data signal terminal under the control of the scan signal terminal, compensating, by the drive controlling sub-circuit, threshold voltage of the driving transistor under the joint action of the potential of the first node and the potential of the second node, and connecting, by the second resetting sub-circuit, the third node with the first node under the control of the first signal control terminal; and in a light-emission period, providing, by the charging sub-circuit, the second node with the signal of the first voltage signal terminal under the control of the first signal control terminal, providing, by the drive controlling sub-circuit, the light-emitting element with driving voltage under the control of the potential of the first node, and providing, by the light-emission controlling sub-circuit, the fourth node with the potential of the third node under the control of the light-emission control signal terminal to drive the light-emitting element to emit light.

12. An organic light-emitting display panel, comprising a plurality of pixel circuits according to claim 1, which are arranged in an array.

13. A display device, comprising the organic light-emitting display panel according to claim 12.

* * * * *